United States Patent [19]

Heumann

[11] 4,077,666

[45] Mar. 7, 1978

[54] MODULAR SEATING ARRANGEMENT AND METHOD

[75] Inventor: Jules M. Heumann, San Francisco, Calif.

[73] Assignee: Metropolitan Furniture Manufacturing Co., South San Francisco, Calif.

[21] Appl. No.: 773,053

[22] Filed: Feb. 28, 1977

[51] Int. Cl.[2] ..... A47C 15/00

[52] U.S. Cl. ..... 297/440; 297/248

[58] Field of Search ..... 297/232, 248, 440; 85/5 R, 80; 312/111; 24/73 P, 73 PF

[56] References Cited

U.S. PATENT DOCUMENTS

| | | | |
|---|---|---|---|
| 2,466,204 | 4/1949 | Brown | 297/440 UX |
| 2,793,685 | 5/1957 | Spitz | 297/440 UX |
| 3,164,418 | 1/1965 | Biesecker | 85/5 R X |
| 3,552,579 | 1/1971 | Simon et al. | 312/111 X |
| 3,669,494 | 6/1972 | Lohmeyer | 297/440 |
| 3,704,486 | 12/1972 | Blacklock | 85/5 R X |
| 3,811,728 | 5/1974 | Redemske | 297/440 |
| 3,908,235 | 9/1975 | Telliard et al. | 85/5 R X |

FOREIGN PATENT DOCUMENTS

| | | | |
|---|---|---|---|
| 1,574,003 | 7/1969 | France | 312/111 |

*Primary Examiner*—James C. Mitchell
*Attorney, Agent, or Firm*—Phillips, Moore, Weissenberger, Lempio & Majestic

[57] ABSTRACT

A modular seating arrangement comprises a plurality of interconnected bases, each defining a pair of female sockets therein. A seat, disposed on the base, has a pair of releasable male fasteners secured thereon which engage within the female sockets. Each male fastener comprises an elongated member having a bifurcated end defining a pair of split locking portions which are expanded into interlocking relationship within a respective one of the female sockets. Back, arm and/or table components may be secured on the base to complete the modular seating arrangement.

10 Claims, 7 Drawing Figures

FIG. 3.
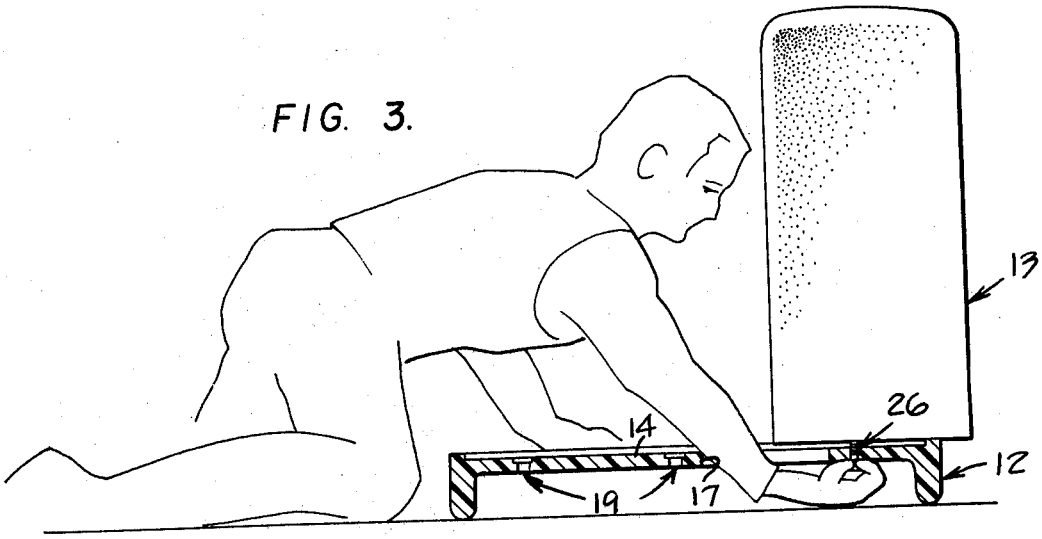
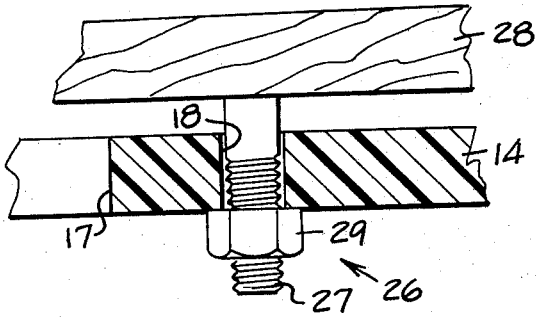
FIG. 4.
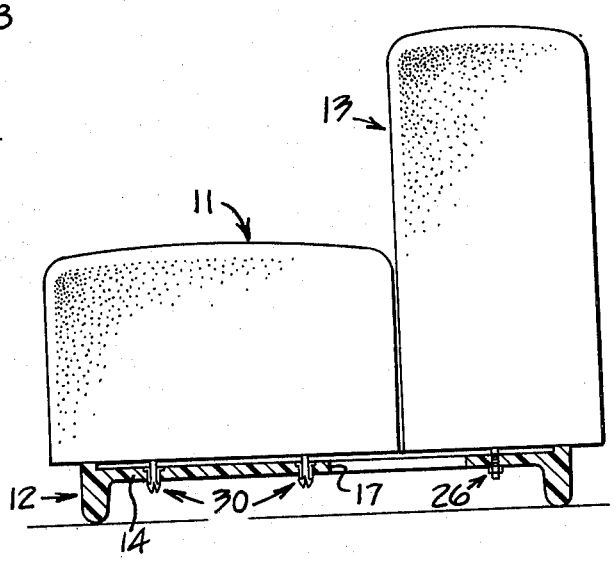
FIG. 5.
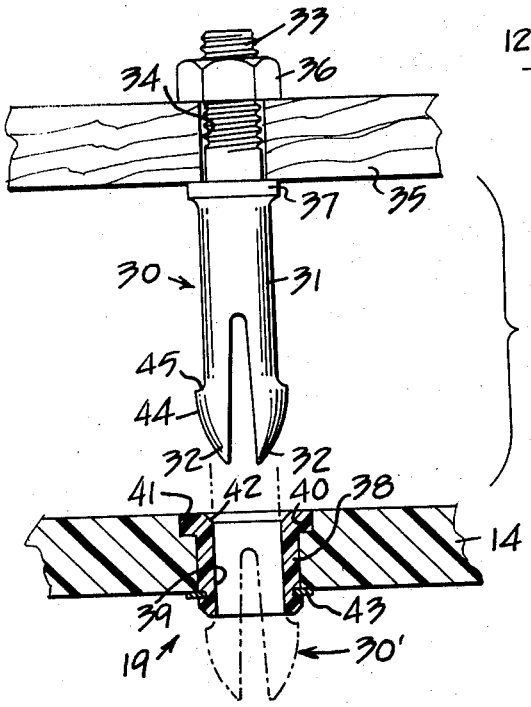
FIG. 6.
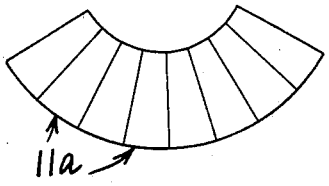
FIG. 7.

MODULAR SEATING ARRANGEMENT AND METHOD

BACKGROUND OF THE INVENTION

A conventional seating arrangement normally comprises a frame having at least one seat cushion and a back cushion secured thereon by screws or bolts. Assembly of such a seating arrangement and disassembly thereof for repair or replacement purposes has proven unduly time-consuming and costly. In addition, such a conventional seating arrangement does not lend itself to various combinations wherein seat and back cushions may be orientated to assume various configurations.

SUMMARY OF THIS INVENTION

An object of this invention is to overcome the above, briefly described problems by providing a modular furniture arrangement adapted to have the configuration thereof selectively varied on site.

The furniture arrangement of this invention meets particular needs not presently being fulfilled by the furniture industry, namely, to provide seating which is both rectilinear and comfortable; to provide highly modular seating capabilities; to provide seating with the ability for individual components to be reupholstered on-site by unskilled labor; and to provide an infinite number of seating and related furniture arrangements, adapted to be assembled from carton to completion without special tools and within a short time period. In addition, components of the furniture arrangement of this invention can be removed expeditiously for repair or replacement purposes.

The furniture arrangement of this invention comprises a base defining at least one female socket means therein and a furniture component having a releasable male fastening means secured thereon. Upon assembly, the furniture component is attached on the base by inserting the male fastening means into expanded and interlocked relationship within the female socket means. The furniture component preferably comprises a seat but can alternatively comprise other types of furniture components, such as tables or arms. In addition, a back component is preferably secured on the base prior to the installation of the seat or other furniture component thereon.

BRIEF DESCRIPTION OF THE DRAWINGS

Other objects of this invention will become apparent from the following description and accompanying drawings wheren:

FIG. 3 is a side elevational and partially sectioned view illustrating installation of a back component on a base of the seating arrangement;

FIG. 4 is an enlarged partially sectioned view illustrating a fastening means for securing the back component on the base;

FIG. 5 is a view similar to FIG. 3, but illustrating a back component and a seat component installed on the base;

FIG. 6 is an exploded view of an interlocking fastening means for securing the seat component on the base; and FIG. 7 is a top plan view illustrating an alternative configuration of integrated seat components employed in the seating arrangement.

DETAILED DESCRIPTION

Figure 1:
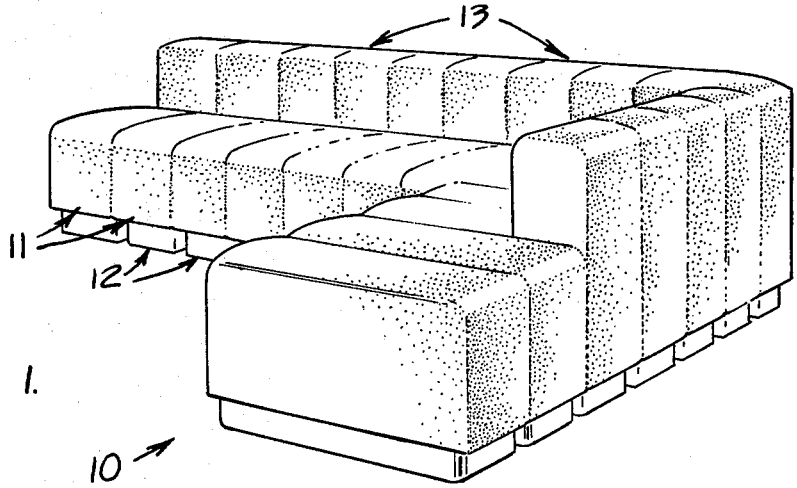
FIG. 1 is a perspective view of a seating arrangement embodying this invention.

FIG. 1 illustrates a seating arrangement 10 comprising a plurality of upholstered seat components 11 each secured on a rigid base or plinth 12. In the configuration illustrated, a number of the bases each also has an upholstered back component secured thereon. Although the invention is hereinafter decribed with reference to a seating arrangement, it should be understood that other furniture components, such as arms or tables, can be secured on bases 12 to form an infinite number of configurations and arrangements.

Figure 2:
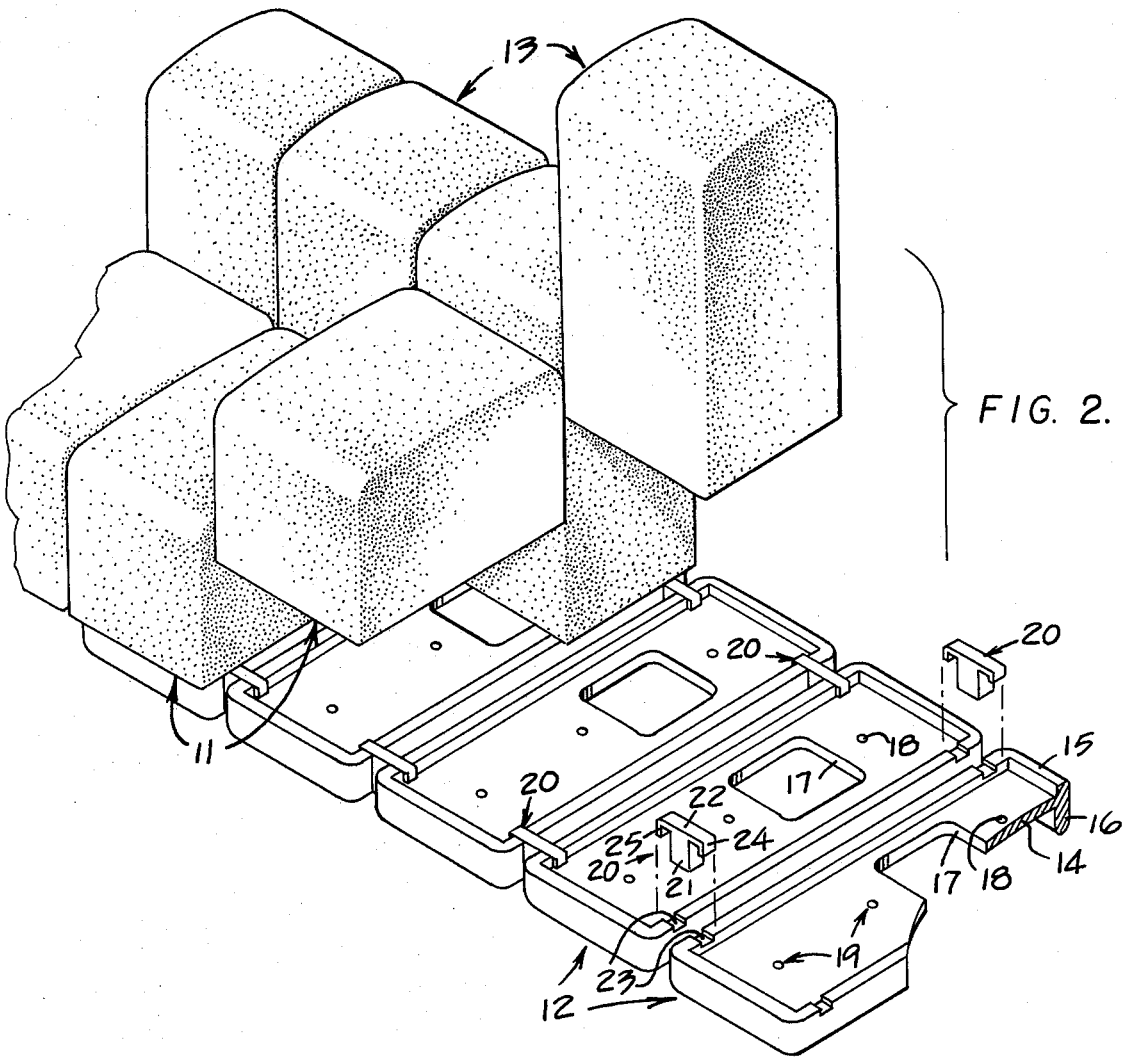
FIG. 2 is an enlarged partial view of the seating arrangement, illustrating component parts thereof in partially assembled form.

Referring to FIG. 2, each base 12 may be composed of any suitable rigid material, such as wood or particle board, which will provide the desired rigid support to the seat and back components of the furniture arrangement. The base comprises a flat intermediate section 14 having an upstanding ridge 15 formed on the periphery of side edges thereof. A rectangular pedestal 16 is secured beneath section 14 to extend downwardly about the periphery thereof.

A rectangular opening 17 is formed through section 14 of the base and is disposed rearwardly thereon to provide an access opening for securing a respective back component 13 on the base, as will be hereinafter more fully described. A single hole 18 is formed through section 14, rearwardly of opening 17, to accommodate a bolt therethrough, as will be hereinafter also described. A pair of female socket means 19 are mounted in section 14 of the base and are disposed in linear alignment, forwardly of opening 17.

Each adjacent pair of bases 12 are attached together by a pair of longitudinally spaced connectors 20. Each connector is generally T-shaped to comprise a vertically disposed central portion 21 having a horizontally disposed upper portion 22 secured thereon. The upper portion of each connector is adapted to be disposed in flush relationship within a pair of slots 23, formed on ridges 15 of the adjacent pair of bases, whereas a pair of laterally spaced and vertically disposed tabs 24 and 25 are secured to opposite ends of upper portion 22 to engage opposite sides of the ridges. The connectors thus space and attach side edges of each adjacent pair of bases together and the connectors are held in place when the seat and back components are secured in overlying relationship thereon.

Referring to FIGS. 3 and 4, after bases 12 have been disposed in their desired configuration, back components 13 are secured thereon. In particular, a single fastening means 26, comprising a threaded stud 27, is secured to a frame 28 of the back component and is inserted through hole 18, formed through section 14 of the base. A nut 29 is threaded onto the stud by a workman who can readily extend his hand and a work tool, such as a wrench, through openings 17. FIG. 4 illustrates a spacing between the upper side of base section 14 and the underside of back frame 28 since back component 13 rests on peripheral portions of ridge 15.

Upon complete installation of the back components on bases 12, each seat component is attached on a respective base by a pair of interlocking fastening means 30, illustrated in FIGS. 5 and 6. Each such fastening means comprises female socket means 19 and a releasable male fastening means 30. The male fastening means comprises an elongated member 31 having a bifurcated end, defining a pair of split locking portions 32.

Member 31 has a threaded end 33 formed thereon which is inserted through a hole 34, formed through a frame 35 of seat component 11. A nut 36 is threadably mounted on the member to secure it in place along with an annular flange 37 which abuts an underside of frame panel 35. Member 31 may be composed of a standard plastic material which will exhibit suitable strength characteristics and also permit compression and spring-back of split locking portions 32 together upon insertion thereof through female socket means 19.

The female socket means comprises a generally cylindrical plastic bushing 38, defining a bore 39 therethrough. An annular flange 40 is formed on an upper, end of the bushing and seats within a like-shaped recess 41, formed on an upper side of section 14 of the base. A frusto-conically shaped cut-out 42 is formed at the upper termination of bore 39. A lower end of bushing 38 is secured in place on the base by a snap ring 43.

Upon insertion of member 31 through bore 39, generally semi-spherical surface portions 44 of each split locking portion 32 will initially engage cut-out 42 of bushing 38 to compress the locking portions together. Upon insertion of male fastening means 29 through bore 39 and to its phantom line position 30', locking portions 32 will expand to dispose semi-annular locking ridges 45 thereof into locking engagement on the underside of bushing 38. Should it be desired to remove a particular seat component 11 from the seating arrangement, a workman need only compress locking portions 32 of each male fastening means 30 together by means of pliers or the like and push the fastening means and seat upwardly relative to the base.

FIG. 7 illustrates a modified furniture configuration where a plurality of wedge-shaped seat components **11*a*** are disposed in an arcuate configuration. A wedge-shaped base (not shown) of the type described above may be utilized to support and secure each seat component in place. Also, back, table and/or arm components may be added thereto, as desired.

I claim:

1. A modular furniture arrangement comprising a pair of adjacent bases each defining at least one female socket means therein;

a furniture component disposed on each of said bases;

a releasable male fastening means secured to said furniture component and expanded into interlocking relationship within said female socket means; and a T-shaped connector releasably attaching said bases together comprising a central portion disposed between said bases to space said bases relative to each other and an upper portion disposed in straddling and interlocking relationship relative to side edges of said bases.

2. The modular furniture arrangement of claim 1 wherein a pair of longitudinally spaced connectors attach side portions of said bases to each other.

3. The modular furniture arrangement of claim 1 further comprising an upstanding ridge formed peripherally on the side edges of each of said bases and a recess formed in said ridge, the upper section of said connector disposed in flush relationship within the recesses formed in said pair of adjacent bases.

4. The modular furniture arrangement of claim 1 wherein said male fastening means comprises an elongated member having a bifurcated and end defining a pair of split locking portions extending through said female socket means.

5. The modular furniture arrangement of claim 4 wherein each of said locking portions has a generally semispherical surface formed thereon adapted to facilitate insertion of said male fastening means through said female socket means.

6. The modular furniture arrangement of claim 4 wherein each of said locking portions has a semi-annular locking ridge defined thereon and wherein said female socket means comprises a bushing secured to said base and wherein the locking ridges of said locking portions engage an underside of said bushing.

7. The modular seating arrangement of claim 6 wherein said bushing has a frusto-conically shaped recess formed on an upper end thereof adapted to receive the locking portions of said elongated member upon insertion of said male fastening means through said female socket means.

8. The furniture arrangement of claim 1 wherein said furniture component constitutes a seat.

9. The furniture arrangement of claim 8 further comprising a back releasably attached on said base by at least one fastening means.

10. The furniture arrangement of claim 9 further comprising means defining an opening through said base for exposing the fastening means attaching said back on said base.

* * * * *